United States Patent [19]

Schmidt

[11] 4,289,273

[45] Sep. 15, 1981

[54] PLATE AND METHOD FOR LAYING RAILWAY LEVEL CROSSINGS

[76] Inventor: Fritz Schmidt, Johann-Strauss-Str. 18, Waldkraiburg, Fed. Rep. of Germany, D-8264

[21] Appl. No.: 917,348

[22] Filed: Jun. 20, 1978

[30] Foreign Application Priority Data

Jun. 20, 1977 [DE] Fed. Rep. of Germany ..... 2727644

[51] Int. Cl.[3] ..... E01C 9/04

[52] U.S. Cl. ..... 238/8

[58] Field of Search ..... 238/8, 3, 6, 9, 2, 4, 238/5, 7

[56] References Cited

U.S. PATENT DOCUMENTS

| | | | |
|---|---|---|---|
| 842,202 | 1/1907 | Howe | 238/7 |
| 1,702,841 | 2/1929 | Ruping | 238/2 |
| 1,721,464 | 7/1929 | Myers | 238/8 |
| 1,743,829 | 1/1930 | Mulvihill | 238/8 |
| 2,420,833 | 5/1947 | Monroe | 238/2 |
| 2,828,079 | 3/1958 | Rennels | 238/8 |
| 2,828,080 | 3/1958 | Rennels | 238/8 |
| 2,984,417 | 5/1961 | Voorhees | 238/8 |
| 3,825,184 | 7/1974 | Hartl | 238/8 |
| 3,843,051 | 10/1974 | Whitlock | 238/8 |
| 3,894,686 | 7/1975 | Weinberg et al. | 238/8 |
| 3,955,761 | 5/1976 | Szarka et al. | 238/8 |
| 4,093,120 | 6/1978 | Canfield | 238/8 |
| 4,117,977 | 10/1978 | Whitlock | 238/8 |

FOREIGN PATENT DOCUMENTS

| | | | |
|---|---|---|---|
| 1076724 | 3/1960 | Fed. Rep. of Germany | 238/8 |
| 1906690 | 1/1974 | Fed. Rep. of Germany | 238/8 |
| 2442660 | 3/1975 | Fed. Rep. of Germany | 238/8 |
| 7536011.1 | 8/1976 | Fed. Rep. of Germany | 238/8 |
| 1140978 | 1/1969 | United Kingdom | 238/2 |

OTHER PUBLICATIONS

"Kunststoffe" 2, 1979 (c), p. 110.

*Primary Examiner*—Randolph A. Reese

[57] ABSTRACT

A plate for laying as a road surface in the vicinity of a railway comprising resilient rubber material delimited by three or more edges, at least one of which is provided with teeth to lock the plate with an adjacent plate against relative movement at right angles to the bearing surface of the plate, the plate being deformable to allow installation of a plate into position alongside already installed plates. The plate may have side edges adapted to fit closely to the rails, with or without a groove for rail wheel flanges. The shapes of the plates are chosen to fit the area between the permanent road, the rails and the side edges of the level crossing.

25 Claims, 7 Drawing Figures

1
1b
1a
9
11
13
13a
2b
2c
2
16
14
17
15
2
13
13
2a
10a
7
7a
5a
5
4
8
10
3
3a
18
6
6a
19

PLATE AND METHOD FOR LAYING RAILWAY LEVEL CROSSINGS

BACKGROUND OF THE INVENTION

The invention concerns a plate for laying as a road surface for railway level crossings, and also a method of producing a railway level crossing using said plates.

Railway level crossings have been made in the past, for example, by laying concrete plates or by asphalting the road sections lying in the vicinity of the rails. Routine maintenance and inspection, by means of X-rays, of the rails for detecting wear, corrosion and other damage, have been complicated and time-consuming when the road is secured to the subsurface. The road surface must on each occasion be destroyed, and after repair work has been carried out, must be renewed; not only is this costly, but it also raises the questions of traffic control, as lengthy diversions frequently prove necessary.

Also, the installation of concrete plate systems has not always been found satisfactory in all respects. In particular, special lifting devices are required for laying concrete plates of this kind. The work associated with installing and removing these known plates is slow and complicated. Considerable costs are therefore incurred and, in the case of repair and maintenance work, road traffic has to be diverted for long periods. It has also been found that concrete plates, in particular so-called rail-supporting plates, cause considerable damage to rails at the ballast bed interface.

SUMMARY OF THE INVENTION

According to the invention there is provided a plate for laying as a road surface at railway level crossings, the plate comprising a resilient rubber material delimited by three or more side edges, the length and shape of the side edges of the plate corresponding to adjacent sections (e.g. of an access road and/or of the road which laterally delimits the level crossing and/or the rails, and/or the side edges of plates which have already been laid), which said adjacent sections delimit at least a part of an intermediate space corresponding to the shape of the plate; further, the profiled edges of the plate snugly abut the profiled edges, lying closer to the plate, of the said adjacent sections, and the thickness of the plate is so selected, on the basis of the resilient properties of the said resilient rubber material, that the plate is to be inserted, by temporarily resiliently deforming it, into the said intermediate spaces; and, when the plate has reassumed its non-deformed condition it is to be locked, by means of the profiled end surfaces of the plate, to the profiled edges, lying closer to these end profiled edges of the plate, of the said adjacent sections.

The method according to the invention—for producing a level crossing of this kind and using the above-mentioned plates according to the invention, in which method the rails, possibly subject to the use of check rails, are fixed to sleepers (rail ties) which are directed transversely of the direction of extent of the rails and are embedded in ballast—is characterized in that the plates are inserted, by temporarily resiliently deforming them, into an intermediate space which approximately corresponds to the surface, as viewed in plan, of the plate, the said intermediate space being delimited by fractions of, for example, the end delimiting surface of the access road and/or of the portions of the roads which laterally delimit the level crossing, and/or of the rails, and/or of the side edges of plates already laid; and by means of its profiled end edges, the plate is caused to form-lockingly engage in the profiled edges of the said sections which delimit the said intermediate space.

The plate according to the invention affords numerous advantages. Owing to the use of a resilient material it is possible to eliminate the above-mentioned damage which has been inflicted on the rails through the material of which the known plates have been composed. Protection has been given to the region in which the rails and sleepers are positioned through resiliently damping the stresses imposed on the road surface by the traffic travelling over the latter. The resilience of the road surface of the level crossing results in smoother and quieter running of the trains, and therefore permits greater travelling speeds of the trains. Further, there is a continuous accommodation of the road surface to the dynamic behaviour of the rail network.

The resilient rubber plates have a noise-damping effect and, by reason of their elasticity, result in quieter running of the road-going vehicles, which contributes to a reduction of the noise nuisance to which the surrounding area of a railway level crossing is subjected.

The plate according to the invention is of very small weight as compared with the known, concrete plates. This mainly accounts for the ease with which these plates can be manipulated and also for the saving in transportation costs. The plates can be laid without the use of special lifting implements and special tools. By means of the profiled end edges of the plates, by means of which the plates are locked to adjacent profiled edges, after the plates have been temporarily resiliently bent, the plates can be installed and removed without difficulty and in an extremely short time, and without the use of further fastening means such as screws, bolts or the like.

As the plate thickness is so selected that the plates are resiliently deformable to some extent, the dimensions of the plate can be so selected that they can be inserted, by their end, profiled edges, into the region lying below the rail heads, although the laid plate can return to its non-deformed condition. No stresses remain in the plate material. Accordingly, the plates lie with the required stability on the underlying surface, and are solely locked in position by means of their profiled end edges.

By reason of their long service life and of the resistance of the resilient rubber material to weathering and industrial effects, the plates constitute a simple and economically viable accessory for the laying of railway level crossings.

The advantages of the plate according to the invention set out above are also true for the method, which also forms part of the subject matter of the invention, of producing a railway level crossing; this is because, for installing and removing the plates, only a short time is needed, no skilled labour is required, and the work can be carried out without the use of special tools. This saving in personnel contributes appreciably to the economic viability of the plate according to the invention.

BRIEF DESCRIPTION OF THE DRAWINGS

Details of the invention will become clear from the following description of some embodiments, given by way of example, with reference to the accompanying drawings, in which.

DETAILED DESCRIPTION OF THE INVENTION

Figure 1:
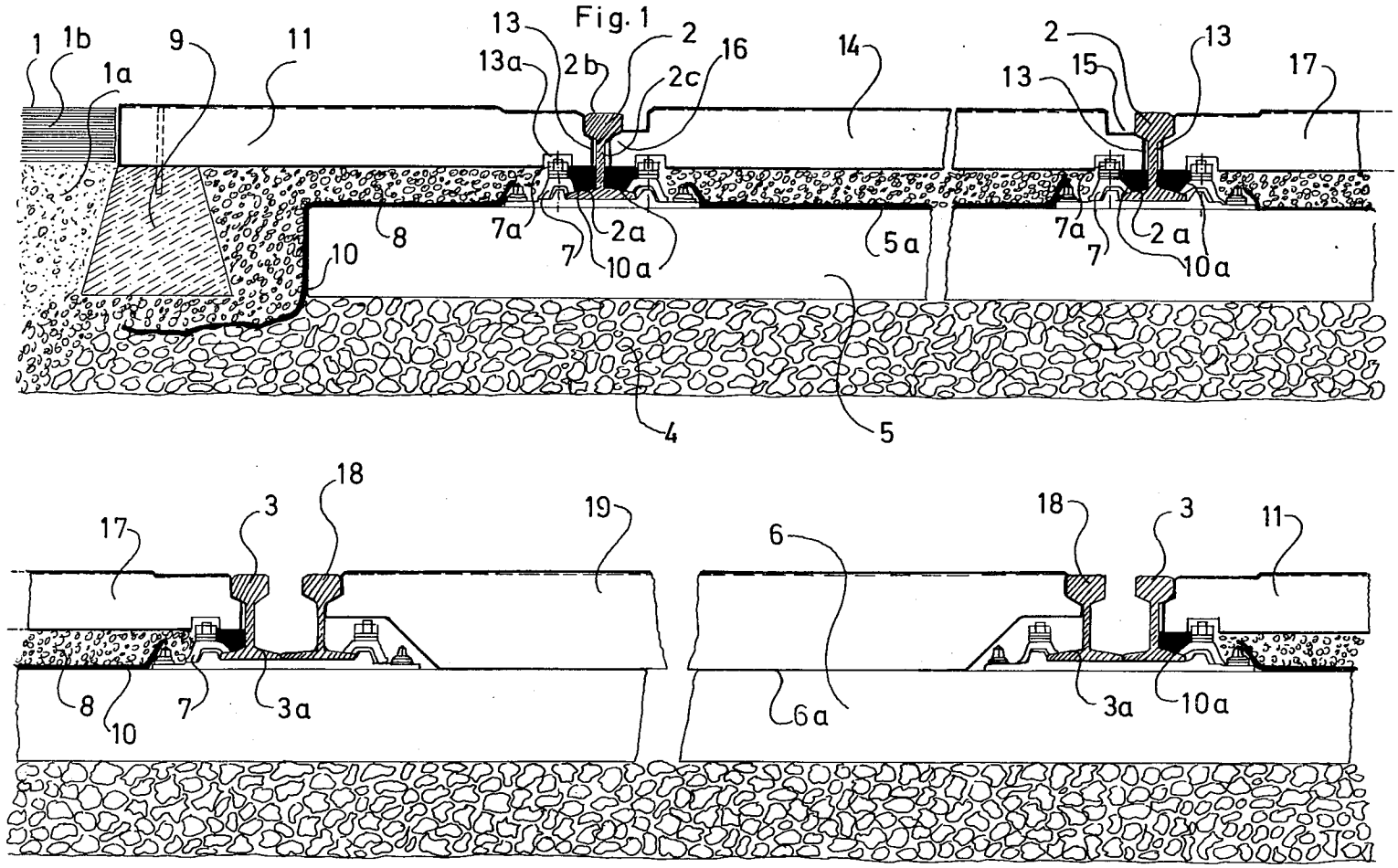
FIG. 1 is a cross-section taken through a railway level crossing, with two pairs of rails, in which four basic embodiments of the plates according to the invention are used.

Two pairs of rails 2 and 3 extend along a railway level crossing, to which an access road 1 leads. The undersurface 4 is constituted by a bed of ballast of a grain size of between 25 and 65 mm. The sleepers (rail ties) 5 and 6 for the pairs 2 and 3 of rails are so embedded in this ballast bed that they are completely surrounded by the ballast except for the exposed surfaces 5*a* and 6*a*. The rail flanges 2*a* and 3*a* are screwed to the sleepers 5 and 6 by means of gripper devices 7. A compensating layer 8 of fine gravel, preferably of feldspathic ware or double broken chippings, lies on the surfaces 5*a* of the sleepers and also on the ballast subsurface between the sleepers, and has a grain size of 8 to 11 mm., this layer 8 extending as far as a foundation stone 9, which delimits the substructure 1*a* of the access road 1.

In order to prevent the fine gravel chips 8 passing into the ballast bed 4 and thereby resulting in an undesired loss of resilience of the ballast bed 4, a layer 10 of synthetic plastics material or resilient rubber material is applied to the surface of the ballast before the application of the fine gravel.

The space between the gripper device 7 and the adjacent rail flange (e.g. 2*a*) is filled by an inserted supporting block 10*a* whose upper surface corresponds to the upper level of the compensating layer 8 of fine gravel.

It may be possible to dispense with the abovementioned supporting block 10*a* in instances where the plate thickness is so selected that a compensating layer of fine gravel can be dispensed with.

A first road plate 11 is inserted between the end face of the road surface 1*b* and the outer surface of the first rail 2, which extends parallel to the road surface 1*b*. This plate 11 consists of a high-quality, vulcanized resilient synthetic rubber, e.g. a so-called APT-rubber. The upper surface 11*a* of the plate, and also its end face, is constituted by a layer of a rubber which is particularly resistant to ageing, while the underface 11*b* of the plate, which rests on the layer 8 of fine gravel, consists of a rubber material which is particularly resistant to abrasion.

In the example illustrated the plate thickness is about 100 mm., which approximately corresponds to the distance between the surface of the layer 8 of fine gravel and the upper edge of the rail head 2*b*. The thickness of the plate may be greater, depending on the resilience of the rubber material selected. For example, the plate may be so thick that it will be possible to dispense with the provision of a compensating layer of fine gravel, if the resilience of the material permits a temporary deformation, without the use of special tools, for placing the plate in position. Generally speaking, the plate thickness corresponds to the difference between the rail height and the compensating layer of fine gravel (if the latter is provided), or otherwise the rail height measured from the upper edge of the sleeper. In order to permit the manufacture and use of plate sections which are of the greatest possible uniformity, it is usual to vary the layer thickness of the compensating layer 8 of fine gravel as a function of the height of the rails present in each individual case, so as to accommodate this thickness of the layer 8 to the thickness of the plates, commonly used.

The shape of the end surface of the plate 11 lying closer to the rail 2 matches the outer surface of the rail 2; a gap 13 of a width of a few mm. is defined between the end surface of the plate and the web 2*c* of the rail so as to allow for thermal expansion of the plate and thus prevent buckling of the plates. The plate width corresponds to approximately half the track width of the rail 2, i.e. about 725 mm. in the present embodiment. The surface of the plate is provided with a rhomboidal pattern of grooves 12 for increasing its gripping properties (see FIG. 3). In the vicinity of the gripper device 7 the plate 11 has, on its underface, a recess 13*a* for the screws 7*a*.

An inner plate 14, corresponding to the so-called outer plate 11, is wedged between the mutually facing inner profiled surfaces of the rails 2. The parts of the inner plate 14 corresponding to those of the outer plate 11 have the same reference symbols. The surface of plate 14 and of plate 11 lies at approximately the same level as the upper edge of the rail. In the embodiments illustrated the maximum width of the plate 14, measured between the rail webs 2*c*, is about 1470 mm., account being taken of the gap 13 left at each rail web 2*c*. In contradistinction to the outer plate 11, the end face or profile of the inner plate 14 has a track groove 15 in the vicinity of the rail head 2*b*. The snug, form-locking fit of the plate 14 in the space between the adjacent rails is accomplished by the projecting lug 16 at its end face, this lug 16 abutting against the rail web 2*c* and against the underface of the rail head 2*b*. The width of this track groove 15 is for example about 45 to 70 mm. and its depth between 40 and 50 mm. However, these dimensions depend on the height of the head of the rail and on the dimensions of the flange of the train wheels travelling along the rails.

In order to insert the inner plate 14 between the pair of rails 2 this plate 14 is temporarily slightly bent about its centre axis, which extends in the direction of the rail. In this way the projecting lugs 16 can be wedged under the rail heads 2*b*.

However, after the plate 14 has been laid, it resumes its original shape, that is to say it lies flat on the compensating layer 8 of fine gravel, and is not subject to resilient stress. Depending on the resilience of the plate material the thickness of the plate is so selected that this resilient deformation can be effected by hand, simple levering tools being employed.

The outer plate 17 lying adjacent the pair of rails 2 substantially corresponds to the inner plate 14; however, this outer plate 17 is not provided with a track groove 15, and its total width is determined by the distance (itself predetermined) between the adjacent rails. However, it is also feasible to replace the single plate 17 by two plates if the distance between the two rails should necessitate this. The two plates are then locked to one another by means of a tongue and groove type joint provided at the mutually-facing ends of the plates.

In the embodiment illustrated the pairs of rails 3 have the particular feature that a subsidiary or guide rail 18 is provided a short distance away from each rail 3, this guide rail 18 serving for guiding the flange of the train wheels. In this case the laid inner plate 19 may be without the track grooves 15. The end profiled surfaces of the inner plate 19 therefore closely follow the profiled surfaces, which face one another, of the two guide rails 18, and have a shape which is complementary with that of these end surfaces of the guide rails 18. The total width of the plate 19 is determined by the distance between the inner profiles of the two guide rails 18 from one another.

Figure 5:
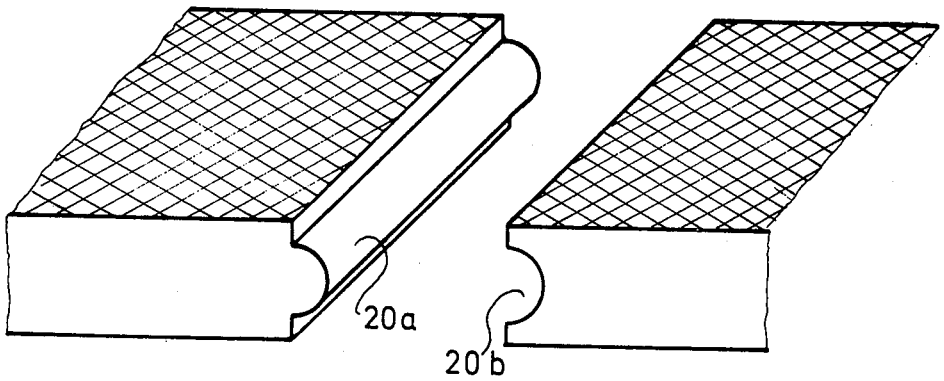
FIG. 5 is an exploded view of two plates, which are interconnected by a tongue and groove joint, only part of which are shown.

It is clear from FIG. 1 that the essential requirement, for producing a railway level crossing, is the provision of a few groups of plates 11, 14, 17 and 19 which only differ from one another in respect of their width and of the profile shape of their longitudinal edges. Adjacent plates, which are of the same group and extend in the direction of the rails, are attached to one another by tongue-and-groove type joints provided at their widthwise sides. As illustrated in FIG. 5, it has been found particularly satisfactory if the joint profiles 20*a, b,* have approximately semi-cylindrical cross-sections. Efficient transmission of transverse forces is ensured by this type of joint; naturally, attention must be devoted to ensuring that these adjacent plate sections are properly joined to one another.

Figure 3:
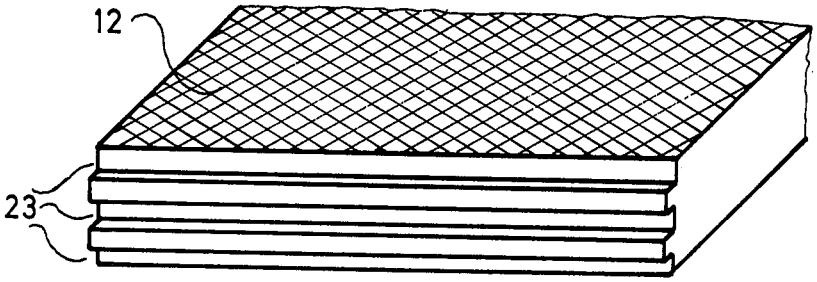
FIG. 3 is a perspective, partial view of a plate section.

As illustrated in FIG. 3, it is also possible to provide, for attaching adjacent plates to one another, successive projections and depressions, which alternate vertically and extend parallel to the plate surface. The use of three rows 23 of teeth has been found satisfactory.

Figure 4:
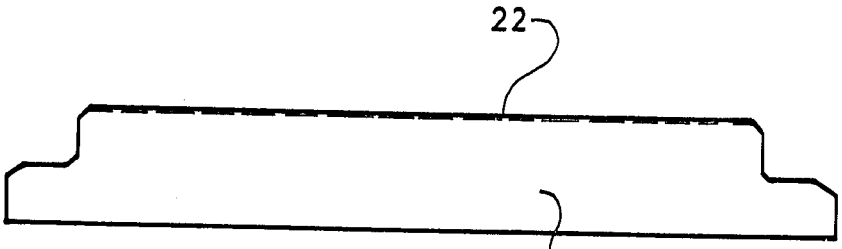
FIG. 4 is a cross-section taken through a plate according to the invention and having a raised surface.

A particularly advantageous aspect of the railway level crossing proposed according to the invention is the high resilience of the plates used as road surfacing elements, these plates resiliently yielding to the shocks and loads imposed when road vehicles travel over the level crossing, so that the passage of these vehicles is relatively quiet. It has been found to be advantageous to provide the plates with a raised portion of about 5 to 10 mm. above the upper surface of the rails. FIG. 4 illustrates a plate 21 having a raised portion 22 of this kind in its central area. This raised portion does not act in the manner of a step to a truck or lorry travelling over it due to the fact that this raised portion can resiliently yield to the pressure presented by this vehicle. The further advantage afforded by a raised portion, thus provided in a plate, is that relatively large settlements can take place in the substructure, underlying the level crossing, in the vicinity of this level crossing, before the level crossing has to be subjected to further tamping.

It has of course been found advantageous, for allowing subsequent settlement of the substructure, underlying the rails, to take place without re-tamping having to be carried out within a short time, to arrange for the surface of the compensating layer of fine gravel to be gently upwardly protuberant. After the underlying surface has settled, the surface of the plate finally assumes its prescribed position, without the above-mentioned raised portion 22 being lost.

Figure 6A:
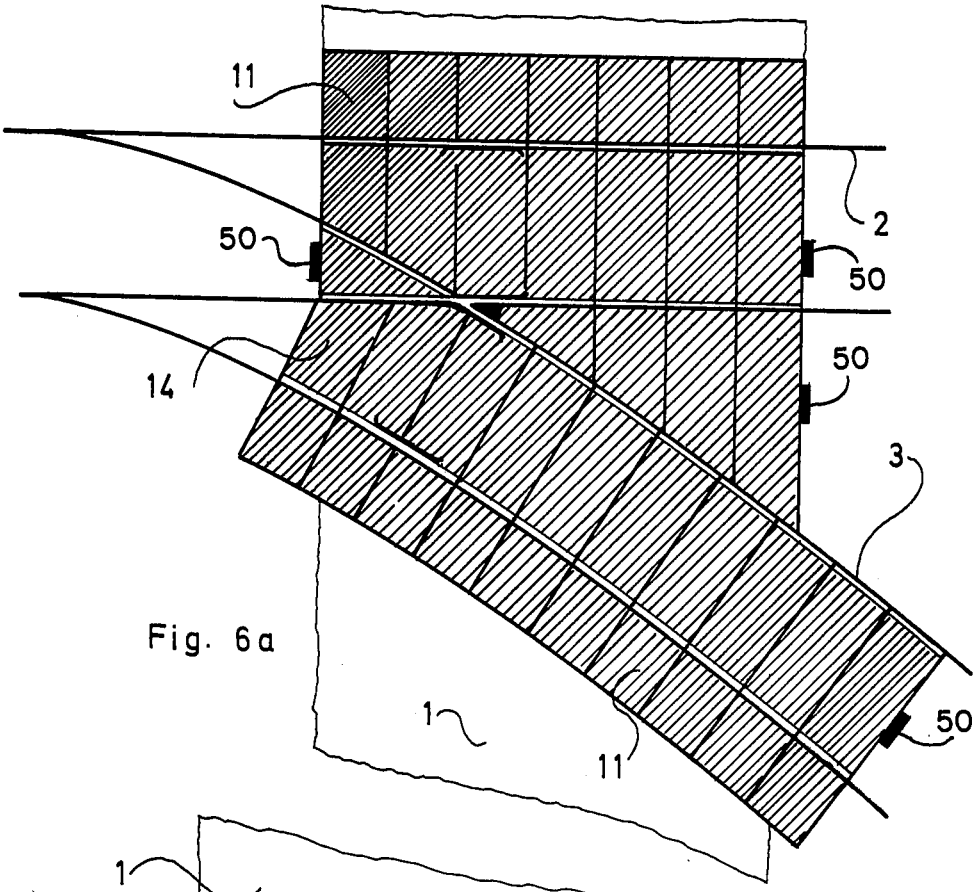
FIG. 6*a* is a plan view of a single switch point in the vicinity of a railway level crossing.
Figure 6B:
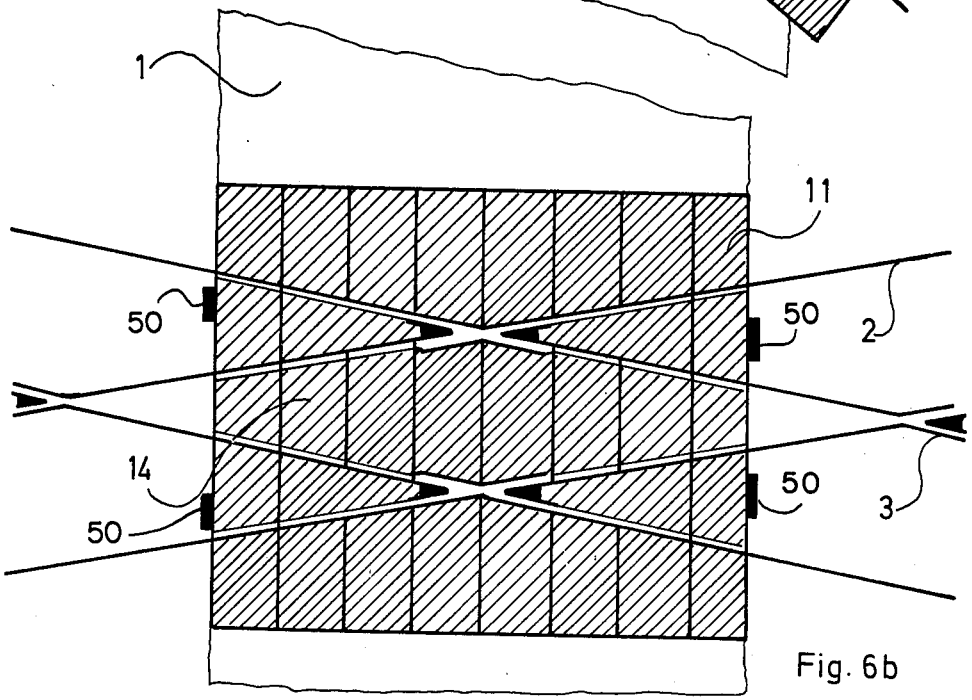
FIG. 6*b* illustrates a crossing in the vicinity of a railway level crossing.

In the case of the (for example) railway level crossing the first and last plate elements of a group of plates are prevented from being shifted in the longitudinal direction, that is to say in the direction or extent of the rails, by blocking means which is schematically illustrated at 50 in FIGS. 6*a* and 6*b* and which is connected to the track, or by means of some other confining device. The plates lying between the said first and last plate elements are prevented from being raised by reason of the tongue-and-groove type joints, with which these intermediate plates are equipped, account being taken of the intrinsic weight of the plates.

Figure 2:
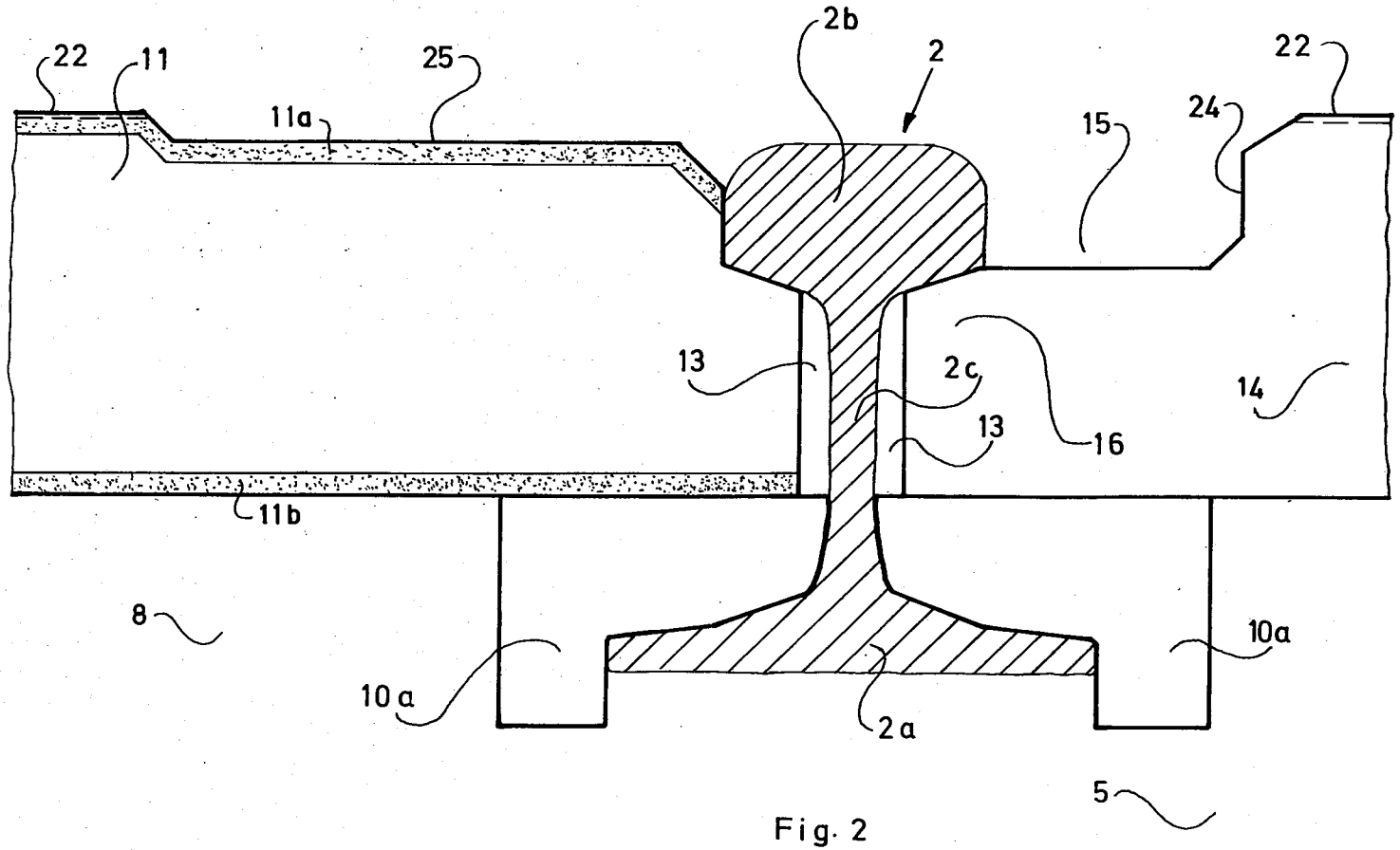
FIG. 2 is a detail of the railway level crossing shown in cross-section in FIG. 1.

FIG. 2 illustrates particularly clearly the track groove 15, the vertical surface 24 constituting both the side edge of this track groove 15 and a side edge of the raised portion 22.

Further, the profile of the plate 11 adjoining the outer profile of the rail 2 has a further, step-like shoulder 25, which constitutes a so-called side clearance and, in accordance with the hitherto-existing rules of the German Federal Railways, must have a width of about 150 mm. measured outwardly from the inner edge of the rail head 2*b*. As shown in FIG. 2, this side clearance is adjoined by the raised portion 22, which projects upwardly about 5 to 10 mm. above the upper edge 2*b* of the rail.

In the above-described embodiments of a plate according to the invention this plate is of substantially rectangular shape. It is clear, from the plan view shown in FIG. 6*a* of a railway level crossing having a single switching point, that the rail does not always extend rectilinearly in the vicinity of this switching point. However, the plate according to the invention can also be used without difficulty in the vicinity of curvilinear sections of rail, as its shape, as viewed in plan, is always to be accommodated to the conditions occurring in practice, its side edges and the profile shape of the latter being accommodated in the curvilinear shape of the rail sections concerned. For instance, as illustrated in FIG. 6*b*, the plates can have rectangular, trapezoidal, or triangular shapes. This affords the advantage that, even in the vicinity of a complicated section of rail, the road surface is without any great interruptions in its continuity, so that traffic travelling over this road surface is afforded optimal safety.

It is clear from the plan views of FIGS. 6*a* and 6*b* that, for producing the road surface in the vicinity of a switching point or of a crossing, plates are required whose edges partially delimit rectangular or trapezoidal surfaces, the side edges of some of the plates being curvilinear so as to accommodate to the rail profile.

Naturally, such plates must be accommodated in accordance with the ground levels, although in the case of the resilient rubber material used for the plates according to the invention, such a cutting to size can, in the case of the resilient rubber material used for the plates according to the invention, be carried out without special difficulties. One particular advantage of the invention is that the interchange of the plates of a complicated shape as viewed in plan can be accomplished here without special difficulties, and damage to the rails is not likely to occur, particularly in the vicinity of the movable parts.

It is, therefore, evident that there has been provided, in accordance with the present invention, a means and a method for providing a level crossing that fully satisfies the objects, aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations that fall within the spirit and broad scope of the appended claims.

What is claimed is:

1. A plate for laying as a road surface between the rails of a railway track crossing, the plate comprising resilient rubber material delimited by at least three side and end edges, the length and relative orientation of said side and end edges defining a section of said road surface;

said edges including at least one side edge shaped for interlocking relation with a complementary shaped side edge of an adjacent plate, and end edges shaped for interlocking relation with a respective inwardly facing side of one of said rails;

said plate being resiliently deformable for insertion into said section of road surface and being self-returning to a non-deformed condition in which said interlocking relation of said edges is obtained so that said plate is held in a desired position with respect to the rails, the interlocking of the at least one side edge with the side edge of an adjacent plate and the interlocking of the end edges with the rails being the only means to restrict vertical movement of said plate, outer side edges of plates forming outer edges of the road surface being contacted by blocking means for restricting movement of the road surface in the longitudinal direction of the rails.

2. A plate as claimed in claim 1 of rectangular, trapezoidal or triangular shape.

3. A plate as claimed in claim 1 having rectilinear and/or curvilinear side edges.

4. A plate as claimed in claim 1, wherein at least one side edge of the plate extends parallel to the rail sleepers.

5. A plate as claimed in claim 4, wherein the distance between two plate sides corresponds to the distance between two sleepers.

6. A plate as claimed in claim 1, wherein said side edge of the plate is shaped with a tongue and groove type joint for interlocking relation with an adjacent plate.

7. A plate as claimed in claim 6, wherein the tongue is semi-cylindrical in cross section.

8. A plate as claimed in claim 6, wherein the tongue and groove joint comprises a row of teeth extending parallel to the road surface of the plate.

9. A plate as claimed in claim 1, wherein the edge intended to lie contiguously with a rail facing the interior of the track has a stepped recess, which extends outwardly from the plate surface and serves as a track groove for the flange of train wheels travelling along the rails.

10. A plate as claimed in claim 1, wherein the plate thickness is selected so as to approximately correspond to the difference between the level of the rail subsurface and the upper edge of the rail.

11. A plate as claimed in claim 1 having a step-like raised portion extending parallel to the rail and whose surface lies above the upper edge of the rail.

12. A plate as claimed in claim 1 having a bearing surface pattern to increase the gripping properties of the plate.

13. A plate as claimed in claim 1 having on its undersurface recesses for co-operation with rail fixtures.

14. A plate as claimed in claim 1 having a resilient rubber material of increased resistance to abrasion on the undersurface of the plate.

15. A plate as claimed in claim 1 having a bearing surface of resilient rubber material which is resistant to ageing and weathering.

16. An assembly of components for laying as a road surface at a railway track crossing of a road, said assembly including first plates and second plates comprising resilient rubber material and defining sections of said road surface;

each of said first plates having an end edge shaped to engage with an outwardly facing surface of a rail and two side edges extending perpendicular to said end edge and shaped to define complementary interlocking surfaces so that the surface of one side edge is interlockable with the surface of a side edge of an adjacent first plate to prevent relative movement therebetween; and each of said second plates comprising an inner plate insertable between inner facing surfaces of two parallel rails, the inner plates having a length greater than the narrowest distance between heads of the rails and being resiliently deformable to fit underneath the heads and between the rails, each of said inner plates having end edges shaped to fit under uppermost portions of inwardly facing surfaces of the parallel rails, and side edges interconnecting and extending perpendicular to said end edges, said side edges being shaped to define complementary interlocking surfaces that protrude into and automatically interlock with a complementary interlocking surface of the side edge of an adjacent inner plate, the interlocking of the side edges being such that the inner plates, when assembled, are held against vertical movement only by the adjacent inner plates and portions of the rails, outer side edges of outermost inner plates, when assembled, being contacted by blocking means rigidly fixed in position with respect to the rails for limiting movement of the assembled inner plates in the longitudinal direction of the rails.

17. A method employing plates for producing a road surface between rails of a railway track crossing in which the rails are fixed on sleepers directed transversely of the rails and embedded in ballast, the plates used in the method having end edges shaped to interlock with inwardly facing surfaces of the rails and at least one side edge shaped to interlock with a side edge of an adjacent plate, the method comprising the steps of:

temporarily deforming a first of said plates and inserting it between the rails to form a section of road surface;

temporarily deforming a second of said plates, inserting the deformed second plate between the rails, and moving the second plate so that a first side edge thereof interlockingly engages with a side edge of the first plate to form a second section of road surface;

temporarily deforming a third of said plates, inserting the deformed third plate between the rails, and moving the third plate so that a side edge thereof interlockingly engages with a second edge of the second plate to form a third section of road surface, the second plate being held in position solely by the interlocking engagement of side edges of said second plate with side edges of the first and third plates and the interlocking of end edges of the second plate with inwardly facing surfaces of the rails;

sequentially temporarily deforming a plurality of said plates, inserting the deformed plates between the rails, and moving the most recently inserted plate so that a side edge thereof interlockingly engages with a side edge of a previously inserted plate to form the remaining sections of the road surface;

allowing the temporarily deformed plates to return to a substantially non-deformed condition in which plates positioned between outermost plates are held against vertical movement solely by interlocking engagement of their side edges with side edges of adjacent plates and the interlocking of end edges of the plates with inwardly facing surfaces of the rails; and positioning blocking members adjacent outermost side edges of outermost plates to thereby restrict movement of the interlocked plates along the longitudinal direction of the rails.

18. A method according to claim 17 including applying a compensating layer of fine gravel to the upper surface of the sleepers and to the ballast bed lying adjacent the sleepers, the thickness of this compensating layer being determined by the difference between the height of the rails and the thickness of the plates concerned.

19. A method according to claim 18, wherein the compensating layer of fine gravel is applied with a plane surface to the ballast bed.

20. A method according to claim 18, wherein the compensating layer of fine gravel is so applied to the ballast bed that this compensating layer is slightly upwardly protruberant.

21. A method according to claim 18 comprising inserting a fleece of plastics material, or of a resilient rubber material which is resistant to abrasion, between the surface of the ballast bed and the compensating layer of fine gravel.

22. A method according to claim 18, wherein the compensating layer of fine gravel is interrupted in the area of the rails by the insertion of supporting blocks, whose height corresponds to the thickness of the particular compensating layer concerned and which serve for supporting the plate edges.

23. A method according to claim 18, wherein a supporting device is so arranged in the end area of the surface of an access road adjacent the rails—this supporting device serving to delimit the compensating layer of fine gravel—that the surface of this supporting device lies at the same heightwise level as the surface of the compensating layer of fine gravel, and serves as a support for the plate lying contiguously of the road surface.

24. A method according to claim 17, wherein, for non-shiftably securing the plates which laterally delimit the road, use is made of the track on which the plate edges rest.

25. A method according to claim 17 comprising temporarily deforming the plates during installation about their centre axis, which extends parallel to the rails.

* * * * *